US011472691B2

(12) United States Patent
OHara et al.

(10) Patent No.: US 11,472,691 B2
(45) Date of Patent: Oct. 18, 2022

(54) ASSEMBLY FOR PROVIDING A PASSAGEWAY FOR A BEVERAGE LINE CONNECTED BETWEEN A BEVERAGE VESSEL CONTAINED IN A CABINET, AND A BEVERAGE TAP SECURED TO A TABLETOP ACCESSORY

(71) Applicants: Timothy OHara, San Diego, CA (US); Vincent Zuwiala, Media, PA (US)

(72) Inventors: Timothy OHara, San Diego, CA (US); Vincent Zuwiala, Media, PA (US)

( * ) Notice: Subject to any disclaimer, the term of this patent is extended or adjusted under 35 U.S.C. 154(b) by 0 days.

(21) Appl. No.: 17/336,226

(22) Filed: Jun. 1, 2021

(65) Prior Publication Data

US 2021/0323805 A1 Oct. 21, 2021

Related U.S. Application Data

(63) Continuation-in-part of application No. 16/797,445, filed on Feb. 21, 2020, now abandoned.

(51) Int. Cl.
*B67D 1/08* (2006.01)
*B67D 1/00* (2006.01)

(52) U.S. Cl.
CPC ..... *B67D 1/0841* (2013.01); *B67D 1/0004* (2013.01); *B67D 2210/00031* (2013.01); *B67D 2210/00049* (2013.01); *B67D 2210/00097* (2013.01)

(58) Field of Classification Search
CPC .. B67D 1/0872; B67D 1/0004; B67D 1/0891; B67D 1/0895; B67D 1/0874; B67D 1/0875; A47J 31/40; A47J 31/42; A47J 31/44; A47J 31/462; A47J 43/0465; A47J 43/0722; B05B 11/0008
USPC ..... 222/78; 285/399–402
See application file for complete search history.

(56) References Cited

U.S. PATENT DOCUMENTS 437,915 A * 10/1890 Costigan ..... F16L 37/252 285/401
2,079,049 A * 5/1937 St Clair ..... B67D 1/0829 215/4
2,414,446 A * 1/1947 Carbone ..... G09F 23/04 40/332
2,792,692 A * 5/1957 Bryan ..... F25D 31/006 62/306
2,981,450 A * 4/1961 Anderson ..... B65D 47/061 222/564
3,232,489 A * 2/1966 Buffington ..... B67D 1/06 222/108

(Continued)

*Primary Examiner* — Paul R Durand
*Assistant Examiner* — Michael J. Melaragno
(74) *Attorney, Agent, or Firm* — Axenfeld Law Group, LLC; Robert R. Axenfeld

(57) ABSTRACT

Described is an assembly that provides a passageway for a beverage line connected between a beverage vessel contained within a cabinet, and a beverage tap secured to a tabletop accessory located on a top surface of the cabinet. When the accessory is secured to both the cabinet and a tabletop accessory, the accessory provides: (i) a passageway for the beverage line while (ii) stabilizing and maintaining the tabletop accessory in a stationary and fixed position relative to the cabinet. The accessory may include an upper connector (fastened to the tabletop accessory) having a female shaft for engaging a male shaft of a lower connector (fastened to the cabinet).

15 Claims, 13 Drawing Sheets

(56) References Cited

U.S. PATENT DOCUMENTS 3,286,385 A * 11/1966 Tate, Jr. ..... B67D 1/0872 40/473
3,295,240 A * 1/1967 Garte ..... G09F 13/00 40/473
3,321,861 A * 5/1967 Tate, Jr. ..... B67D 1/08 40/332
3,752,192 A * 8/1973 Kleppin ..... E03B 9/12 137/802
4,164,853 A * 8/1979 McDonough ..... F25D 3/06 222/108
4,350,267 A * 9/1982 Nelson ..... B67D 1/04 222/131
4,708,370 A * 11/1987 Todd ..... F16L 25/0045 277/615
4,878,695 A * 11/1989 Whitham ..... F16L 37/252 285/39
4,893,426 A * 1/1990 Bixler ..... F16B 7/20 403/299
5,232,129 A * 8/1993 Guerra ..... B67D 1/06 137/375
5,412,547 A * 5/1995 Hornblad ..... B67D 1/0872 362/183
5,549,228 A * 8/1996 Brown ..... B65D 83/207 222/402.1
5,564,602 A * 10/1996 Cleland ..... F25D 17/02 222/146.6
6,158,626 A * 12/2000 Guerra ..... B67D 1/06 137/377
6,216,914 B1 * 4/2001 Martucci ..... B67D 1/0084 222/400.8
6,322,284 B1 * 11/2001 Bonardo ..... B60K 23/02 403/348
6,481,238 B1 * 11/2002 Jennings ..... B67D 1/06 62/457.4
7,401,820 B2 * 7/2008 Niki ..... F16L 37/088 285/305
7,604,632 B2 * 10/2009 Howlett ..... A61B 18/0218 606/25
7,743,624 B2 * 6/2010 Schneller ..... B67D 1/0872 62/389
7,861,892 B1 * 1/2011 White ..... F25D 3/08 222/108
8,070,189 B2 * 12/2011 Yow ..... F16L 37/248 285/332.1
8,870,030 B2 * 10/2014 Demarest ..... B65D 83/207 222/153.14
8,985,398 B2 * 3/2015 Demarest ..... B65D 83/22 222/182
10,149,527 B2 * 12/2018 Thorez ..... A45D 34/00
10,752,489 B1 * 8/2020 Alger ..... B67D 1/0841
2004/0163288 A1 * 8/2004 Bydalek ..... B67D 1/0872 40/332
2004/0177893 A1 * 9/2004 Younkle ..... B67D 1/14 141/1
2005/0024850 A1 * 2/2005 Turner ..... G09F 23/08 362/96
2006/0207679 A1 * 9/2006 Ross ..... B67D 1/0877 141/94
2006/0272348 A1 * 12/2006 Kyees ..... B67D 1/0858 62/390
2008/0014064 A1 * 1/2008 Dixon ..... B67D 1/0871 414/419
2010/0089950 A1 * 4/2010 Helf ..... B65D 83/206 222/153.09
2011/0100049 A1 * 5/2011 Bax ..... B67D 1/0884 62/396
2012/0298693 A1 * 11/2012 Jersey ..... B67D 1/0078 222/129.1
2014/0217126 A1 * 8/2014 Peirsman ..... B67D 1/0867 222/399
2014/0232108 A1 * 8/2014 Tracey ..... F16L 21/00 285/305
2014/0367418 A1 * 12/2014 McNitt ..... B67D 1/0891 222/183
2015/0102063 A1 * 4/2015 Hunter ..... B67D 1/0862 222/146.1
2015/0129617 A1 * 5/2015 Peirsman ..... B67D 1/0857 222/399
2015/0129618 A1 * 5/2015 Peirsman ..... B67D 1/0431 222/399
2016/0257553 A1 * 9/2016 Banus Ricoma .... B67D 1/0891
2017/0210610 A1 * 7/2017 Henson ..... B67D 1/1218
2017/0362072 A1 * 12/2017 Garcia ..... B67D 1/06
2018/0099852 A1 * 4/2018 Qiu ..... B67D 1/0004
2018/0099853 A1 * 4/2018 Qiu ..... B67D 1/0004
2018/0100692 A1 * 4/2018 Qiu ..... B67D 1/06
2018/0100693 A1 * 4/2018 Qiu ..... F25D 11/00
2019/0127202 A1 * 5/2019 Fitzgerald ..... B67D 1/0829
2019/0169013 A1 * 6/2019 Paauwe ..... B67D 1/0406

* cited by examiner

ASSEMBLY FOR PROVIDING A PASSAGEWAY FOR A BEVERAGE LINE CONNECTED BETWEEN A BEVERAGE VESSEL CONTAINED IN A CABINET, AND A BEVERAGE TAP SECURED TO A TABLETOP ACCESSORY

The present application claims the benefit of and is a Continuation-in-Part of U.S. patent application Ser. No. 16/797,445, filed Feb. 21, 2020, entitled "Apparatus For Dispensing Beverages With A Disguised Dispensing Tap."

BACKGROUND

Craft and home brewing have experienced significant growth over the past couple of decades. In addition to cans and bottles, craft and home brewer also store and distribute their beers in smaller kegs such as sixtel kegs or Cornelius kegs. For home consumption, many beer drinkers store and dispense their beer from kegs utilizing a kegerator.

A kegerator is a refrigeration unit configured to store and dispense carbonated beverages from a keg stored inside the refrigeration unit. Usually, a kegerator includes a tower-mounted faucet or dispensing tap for dispensing carbonated beverages from the keg.

For the most part, kegerators are primarily functional, and not an aesthetically suitable piece of furniture. Therefore, most people refrain from locating a kegerator in common areas of their home, such as a family room, dining room, living room, or even their kitchen.

SUMMARY

Described is an apparatus for dispensing beverages.

In one aspect an assembly provides a passageway for a beverage line connected between a beverage vessel contained within a cabinet, and a beverage tap secured to a tabletop accessory located on a top surface of the cabinet. When the accessory is secured to both the cabinet and a tabletop accessory, the accessory provides: (i) a passageway for beverage line while (ii) stabilizing and maintaining the tabletop accessory in a stationary and fixed position relative to the top of cabinet. In other words, the assembly helps to stabilize a tabletop accessory and prevent it from toppling over, from the weight of a beverage line, and the force of a person pushing or pulling on the handle of a dispensing tap connected to the tabletop accessory. In one example, the accessory may include an upper connector (fastened to the tabletop accessory) having a female shaft for engaging a male shaft of a lower connector (fastened to the cabinet).

In another aspect an apparatus includes a kegerator contained within a furniture cabinet with an open internal space sizable enough to store a beverage container, such as a sixtel keg of beer or PET (polyethylene terephthalate) keg of wine. On top of the cabinet, the apparatus further includes a decorative element (tabletop accessory) with a dispensing tap mounted to the side of the decorative element. Such a decorative element is removably attached to the cabinet. The apparatus also includes a beverage line connected to the dispensing tap that is fed through the decorative element into the open space within the cabinet, in order to allow dispensing of a beverage stored in the cabinet.

In addition, the apparatus includes connector units for removably attaching the decorative item to the top of the cabinet. The connector units can take several forms, some of which allow for quick removal of the decorative item. For example, the connector unit attached to the decorative item can include a disk with panels that are configured to engage with corresponding openings located at the top of the cabinet. In another example, the connector unit attached to the decorative item can include a peg that is configured to engage with a corresponding opening located at the top of the cabinet. In yet another example, the connector unit includes a first plate connected to the bottom of the decorative item, and a second plate connected to a flat surface, such as the top of the cabinet. The first plate includes a pair of female slots. The second plate includes a pair of male prongs extending from an upper-most surface of the second plate opposite the flat surface. The male prongs are adapted to insert in and engage the female slots, when twisted thereon. Located in central area of the first and second plates is a through-hole for receiving a beverage line fed from the refrigeration unit into the decorative item. In one more example, the connector units each include vertically aligned cylinders that slide into each other when the connector units are engaged with each other. These cylinders are configured so that they can spin around each other. In this example, the cylinders provide additional stability for the decorative element and allow the connectors to engage through surfaces of varying thickness. Each of the above-described examples of connector units allow the decorative item to be quickly replaced with a second, different decorative item.

As appreciated by those skilled in the art, after having the benefit of this disclosure, other suitable connector systems may be used to fasten the decorative item to the cabinet.

The cabinet may have an aesthetically suitable facade and other storage areas, such as drawers, that are not connected to the internal storage space. The cabinet's storage space may include a refrigeration unit for cooling beverages and insulation for minimizing heat transfer. In such a configuration, the cabinet would also include vents for allowing air to flow in and out of the cabinet to the refrigeration unit.

The decorative item removably attached to the top of the cabinet can take numerous forms including but not limited to a lamp, a vase, a statue, or other suitable items in which a beverage line and dispensing tap can be incorporated. For instance, if the decorative item is lamp, it may include a beer supply-line integrated with a dispensing tap coming out of the side of the lamp. The lamp may also include fully functional electrical components.

In another aspect, the decorative item includes a rotational element that allows the decorative item to be turned 180 degrees. This hides the dispensing tap when the beverage dispensing functionality is not in use.

In yet another aspect, the decorative item can be replaced with a second decorative item that does not include a dispensing tap when the beverage dispensing functionality is not in use.

In yet another aspect, the apparatus includes a heating unit in place of a refrigeration unit in order to warm beverages such as hot cider or mulled wine.

This summary is provided to introduce a selection of concepts in a simplified form that are further described below. This summary is not necessarily intended to identify key features or essential features of the claimed subject matter, nor is it necessarily intended to be used as an aid in determining the scope of the claimed subject matter.

The foregoing outlines examples of this disclosure so that those skilled in the relevant art may better understand the detailed description that follows. Additional embodiments and details will be described hereinafter. Those skilled in the relevant art should appreciate that they can readily use any of these disclosed embodiments as a basis for designing or modifying other structures or functions for carrying out the invention, without departing from the spirit and scope of the invention.

Reference herein to "one embodiment," "an embodiment," "an aspect," "an implementation," "an example," or similar formulations, means that a particular feature, structure, operation, or characteristic described in connection with the embodiment is included in at least one embodiment of the present invention. Thus, different appearances of such phrases or formulations herein do not necessarily refer to the same embodiment. Furthermore, various particular features, structures, operations, or characteristics may be combined in any suitable manner in one or more embodiments.

BRIEF DESCRIPTION OF THE DRAWINGS

The detailed description is described with reference to the accompanying figures. In the figures, the left-most digit(s) of a reference number identifies the figure in which the reference number first appears. The figures are not necessarily drawn to scale.

DETAILED DESCRIPTION

Described is an apparatus for dispensing beverages. Some embodiments of the apparatus may be described with reference to FIGS. 1 through 18.

Figure 1:
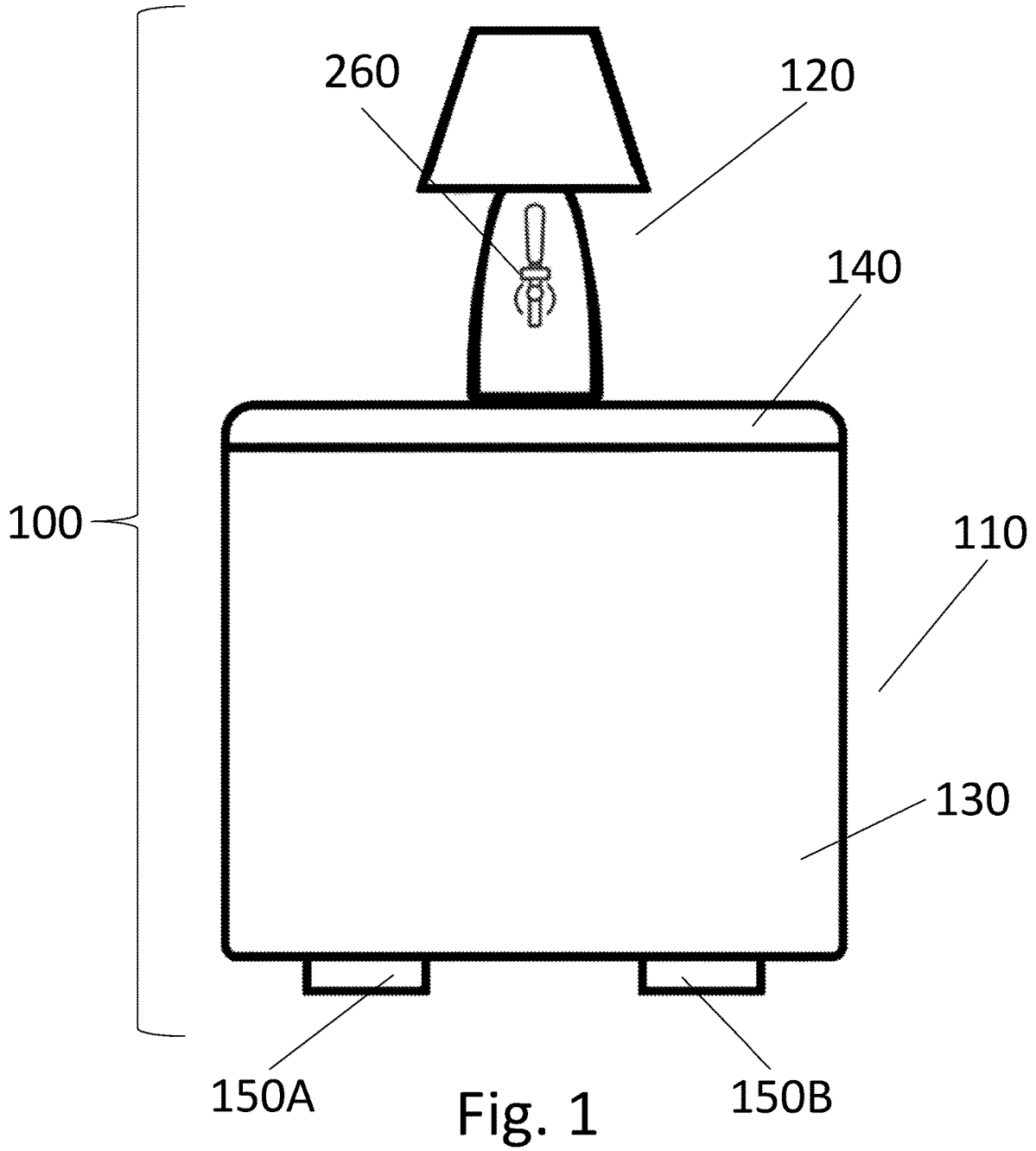
FIG. 1 shows a frontal view of an embodiment of a beverage dispensing apparatus including a cabinet and a decorative element.

FIG. 1 shows a frontal view of an embodiment of the apparatus 100. Apparatus 100 may include a cabinet 110 and a decorative element 120. Cabinet 110 and decorative element 120 are removably attached by connector units 310 and 510 (not shown in FIG. 1, but shown in FIGS. 3 and 5, respectively).

Cabinet

As shown in FIG. 1, cabinet 110 includes at least one side panel or wall 130 and a top panel or table 140.

In one embodiment, cabinet 110 includes feet 150A and 150B (collectively 150). As appreciated by those skilled in the art, after having the benefit of this disclosure, feet 150 can take several forms including that of wheeled feet that a user of apparatus 100 could use to move apparatus 100.

Figure 2A:
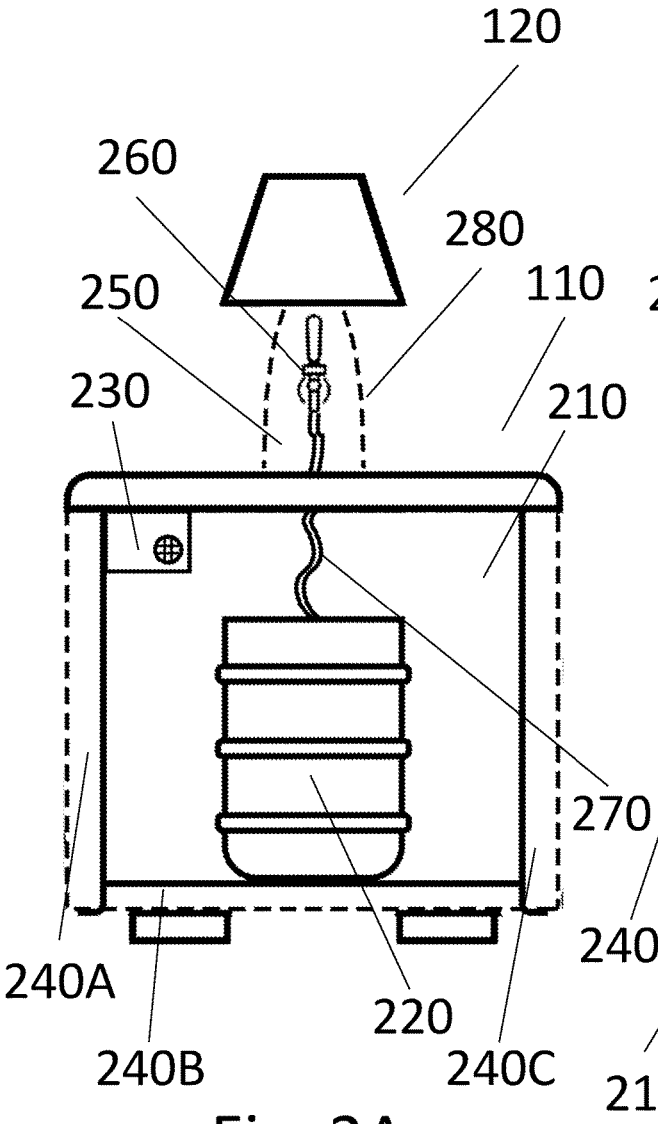
FIG. 2A shows a frontal view of an embodiment of a beverage dispensing apparatus with an internal view of a cabinet and a decorative element.
Figure 2B:
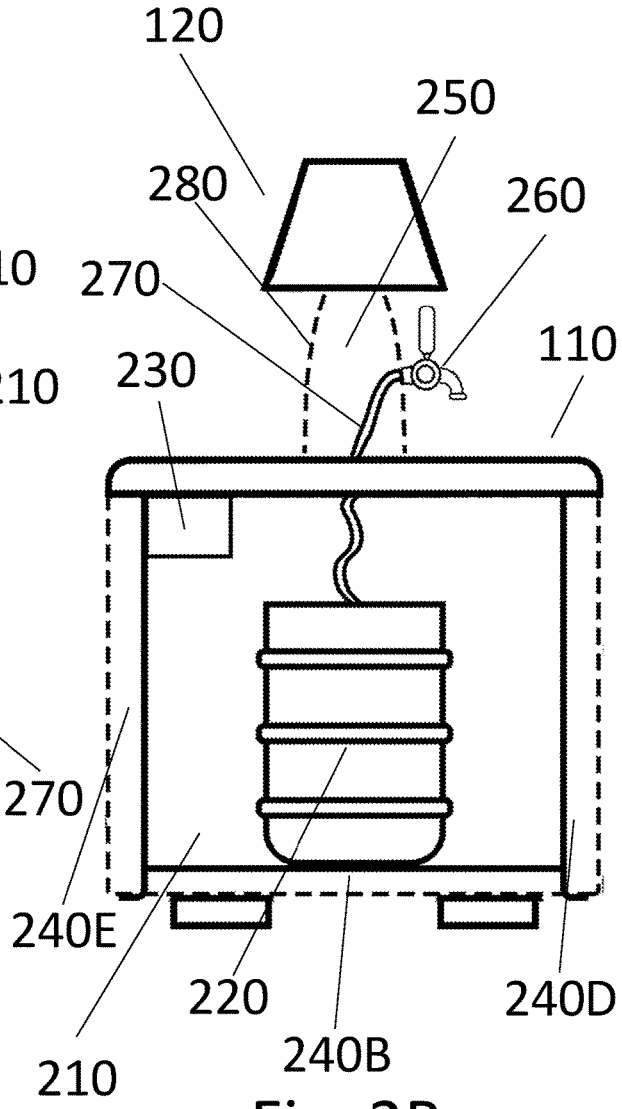
FIG. 2B shows a side view of an embodiment of a beverage dispensing apparatus with an internal view of a cabinet and a decorative element.

Moving to FIGS. 2A and 2B, cabinet 110 is shown to include a storage space 210. As appreciated by those skilled in the art, after having the benefit of this disclosure, storage space 210 can take several shapes and sizes as long as storage space 210 is large enough to hold a beverage container 220. Storage space 210 is configured to accommodate numerous types of beverage container 220 including but not limited to a sixtel keg, Cornelius keg, pony keg, or PET keg. These can dispense various types of beverages including but not limited to beer, wine, cider, or soda.

In FIGS. 2A and 2B, cabinet 110 is shown as including refrigeration unit 230 and insulation panels 240A, 240B, 240C, 240D, and 240E (collectively 240). As appreciated by those skilled in the art, after having the benefit of this disclosure, refrigeration unit 230 can use one of several different cooling methods including but not limited to vapor-compression cooling or gas-cycle cooling. In one embodiment, refrigeration unit 230 connects to a wall power outlet (not shown), generally for indoor use. In another embodiment, refrigeration unit 230 connects to a portable power source such as a solar panel or gas-powered generator (not shown), generally for outdoor use. As appreciated by those skilled in the art, after having the benefit of this disclosure, insulation panels 240 can be composed of several different types of materials including but not limited to foam board, fiberglass, or ceramics.

Decorative Element

Continuing with FIGS. 2A and 2B, decorative element 120 is shown as including an open internal space 250 and a dispensing tap 260.

Inside of internal space 250, a beverage line 270 is attached to dispensing tap 260. Beverage line 270 feeds through a first beverage-line port (not shown in FIGS. 2A and 2B, but shown in FIG. 4 as beverage-line port 400) and a second beverage-line port (not shown in FIGS. 2A and 2B, but shown in FIG. 5 as beverage-line port 500) into storage space 210 to connect to beverage container 220. Beverage line 270 allows beverages to flow from beverage container 220 out of dispensing tap 260 when a user of apparatus 100 engages dispensing tap 260.

Dispensing tap 260 is attached to an outer edge 280 of decorative element 120. As appreciated by those skilled in the art, after having the benefit of this disclosure, dispensing tap 260 can take several forms including but not limited to that of a standard American tap, a European tap, or a nitrogen stout beer tap.

Connector Units and Rotational Element

Figure 3:
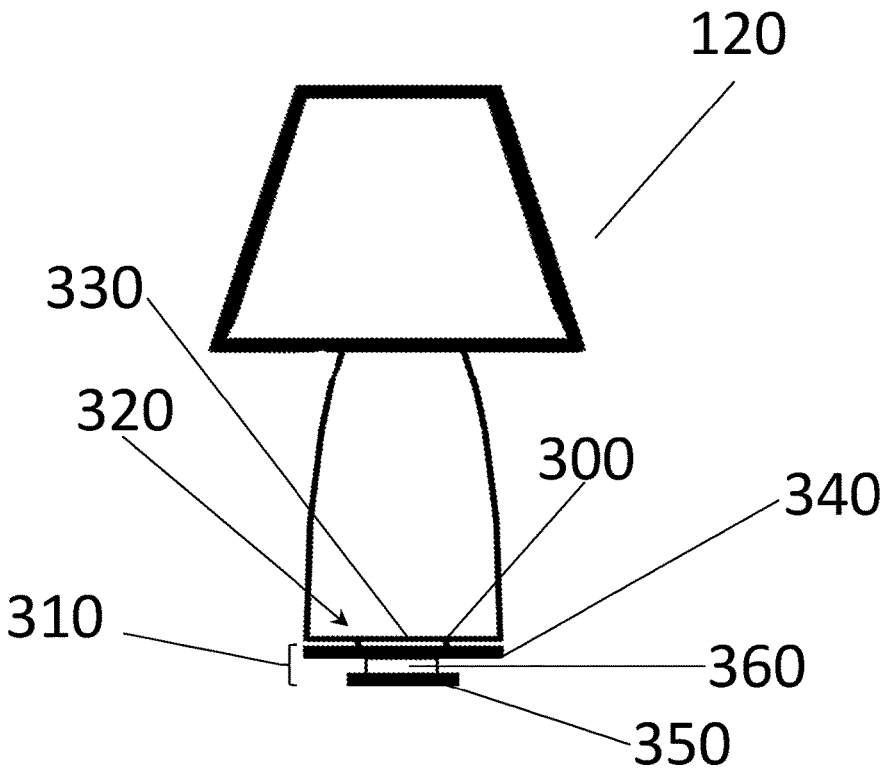
FIG. 3 shows a rear view of a decorative element with a connector unit with horizontal panels.

In FIG. 3, decorative element 120 is shown as further including a rotational element 300 and a first connector unit 310, both of which are located at a bottom portion 320 of decorative element 120.

Rotational element 300 allows decorative element 120 to rotate around a central point 330 of decorative element 120. As appreciated by those skilled in the art, after having the benefit of this disclosure, rotational element 300 can take several different forms including but not limited to pivoting plates or a series of contained ball bearings.

In the embodiment shown in FIG. 3, first connector unit 310 is shown as including a first disk 340 and a second disk 350 connected by cylinder 360 with first disk 340 and second disk 350 each located at opposing distal ends of cylinder 360. First disk 340 is also located adjacent to rotational element 300. First disk 340 and second disk 350 are oriented such that they are approximately parallel to each other and perpendicular to cylinder 360.

Figure 4:
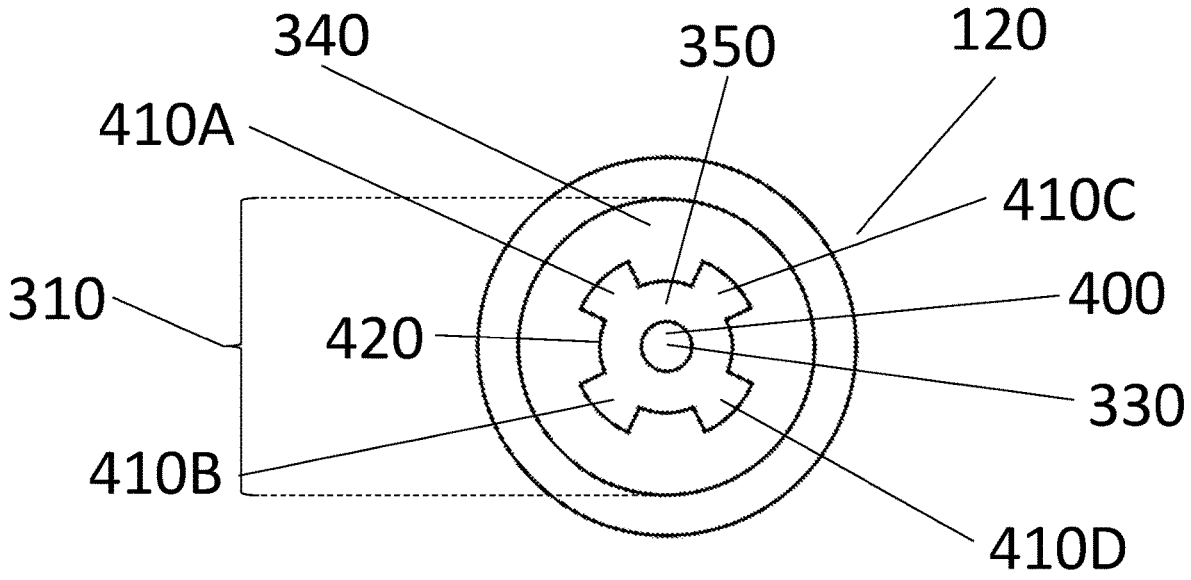
FIG. 4 shows a bottom view of a rotational element and a connector unit with horizontal panels.

As shown in the embodiment in FIG. 4, second disk 350 further includes a first panel 410A located along an outer edge 420 of second disk 350, a second panel 410B located along outer edge 420 of second disk 350 approximately ninety degrees from first panel 410A, a third panel 410C located along outer edge 420 of second disk 350 approximately ninety degrees from first panel 410B, and a fourth panel 410D located along outer edge 420 of second disk 350 approximately ninety degrees from first panel 410A and third panel 410C (collectively, panels 410).

First connector unit 310 also includes the previously mentioned beverage-line port 400 located at central portion 330.

Figure 5:
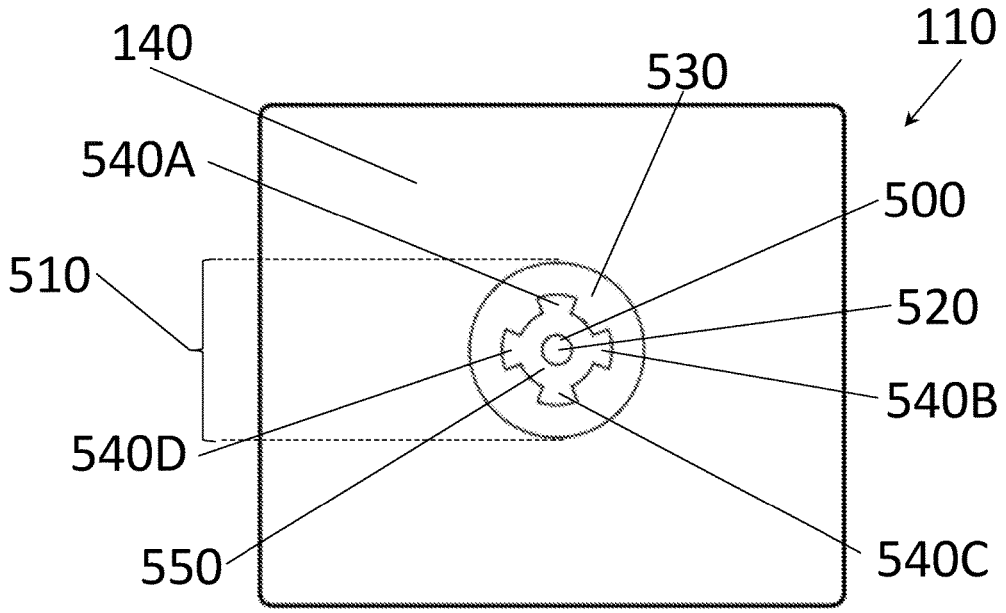
FIG. 5 shows a top view of a cabinet including a connector unit with notches for horizontal panels.

In the embodiment shown in FIG. 5, cabinet 110 further includes a second connector unit 510 located around a central portion 520 of table 140.

Second connector unit 510 is configured to engage with first connector unit 310. Therefore, second connector unit 510 includes a third disk 530 located around central portion 520.

Third disk 530 includes a first notch 540A located around an empty interior space 550 of third disk 530, a second notch 540B located around interior space 550 of third disk 530 approximately ninety degrees from first notch 540A, a third notch 540C located around interior space 550 of third disk 530 approximately ninety degrees from second notch 540B, and a fourth notch 540D located around interior space 550 of third disk 530 approximately ninety degrees from first notch 540A and third notch 540C (collectively, notches 540). Notches 540 are configured in a manner as to engage with panels 410.

Second connector unit 510 also includes the previously mentioned beverage-line port 500 located at central portion 520.

Figure 6:
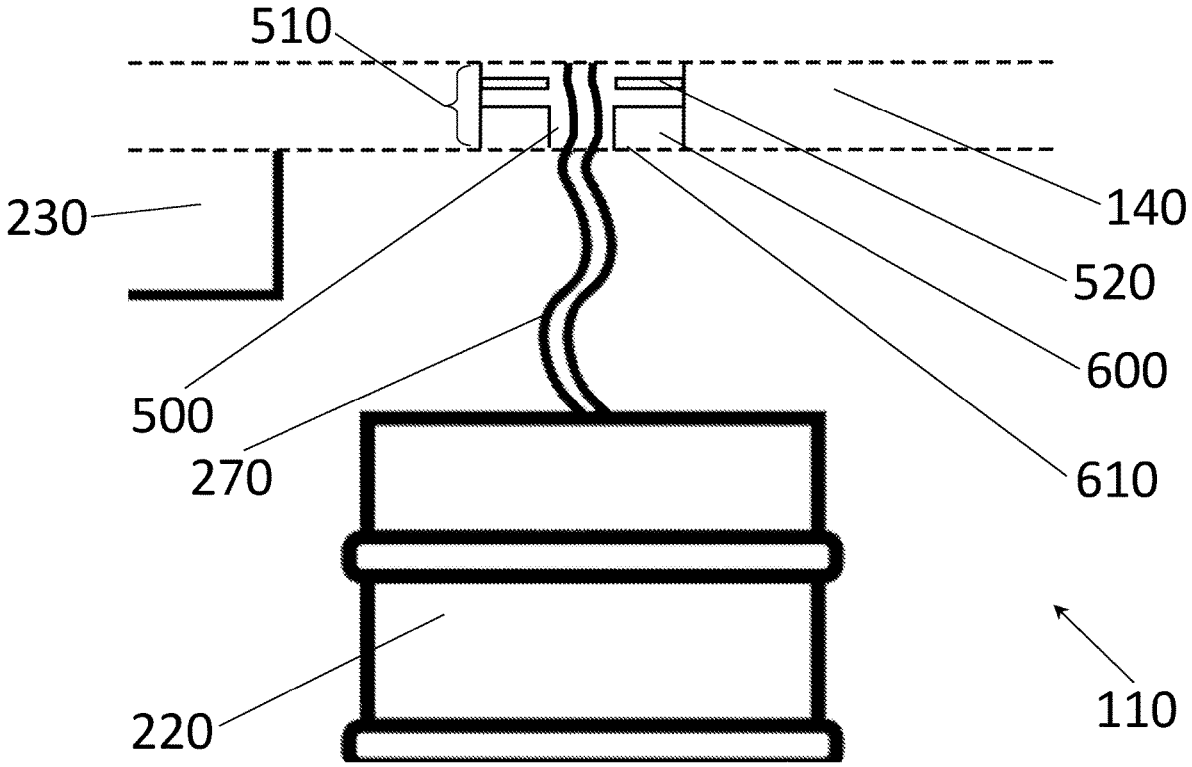
FIG. 6 shows a side view of a portion of a cabinet including a connector unit with notches for horizontal panels.

Second connector unit 510 further includes a fourth disk 600 as shown in FIG. 6. Fourth disk 600 is located at a bottom portion 610 of table 140. Fourth disk 600 is configured in a manner that allows second disk 350 to sit atop fourth disk 600 when first connector 310 is engaged with second connector 510. In one embodiment, second connector unit 510 is affixed to table 140 at bottom portion 610.

Figure 7:
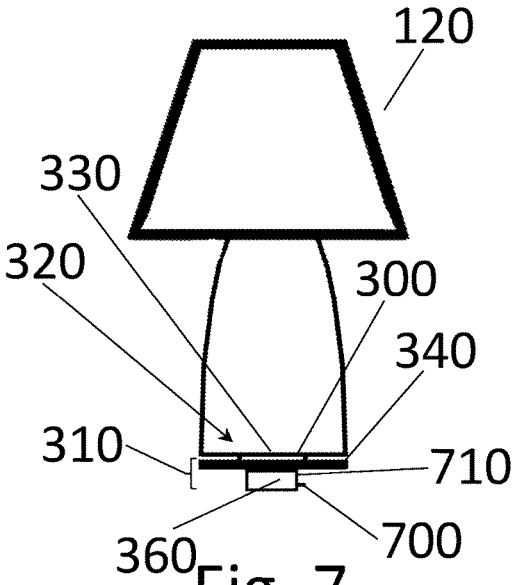
FIG. 7 shows a rear view of a decorative element with a connector unit with a peg.
Figure 8:
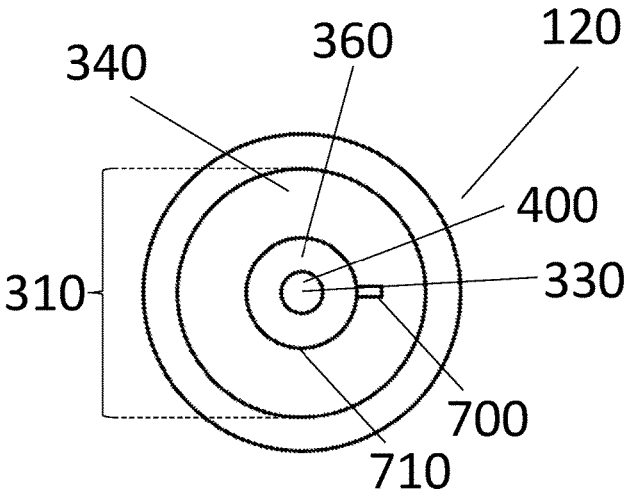
FIG. 8 shows a bottom view of a rotational element and a connector unit with a peg.

In another embodiment shown in FIGS. 7 and 8, first connector unit 310 does not include second disk 350, but instead includes a peg 700. Peg 700 is attached to cylinder 360 along an outer edge 710 of cylinder 360. Peg 700 is oriented approximately parallel to first disk 340 and is positioned toward an end of cylinder 360 opposite first disk 340.

Figure 9:
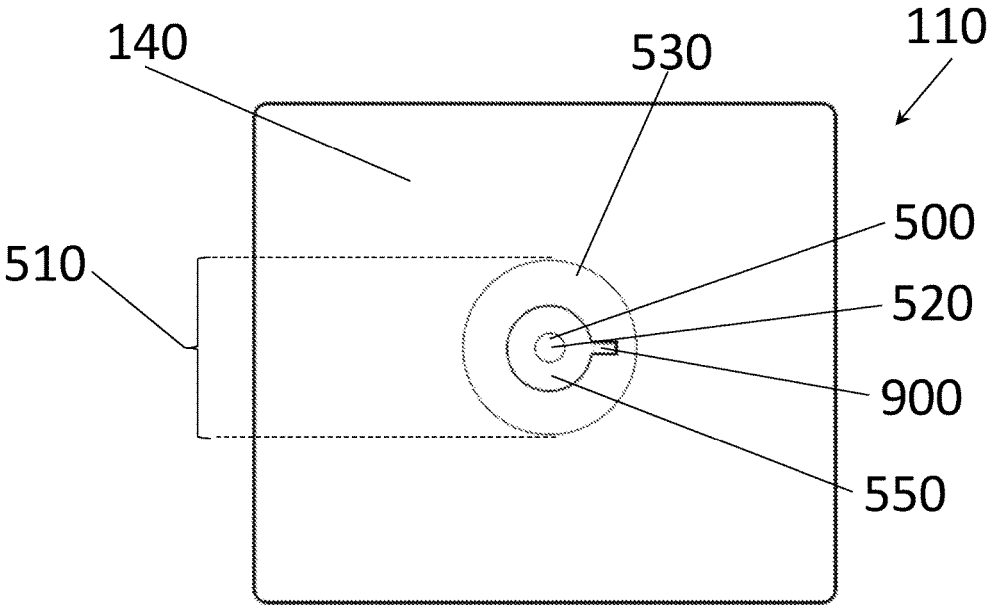
FIG. 9 shows a top view of a cabinet including a connector unit with a notch for a peg.

In the embodiment shown in FIG. 9, second connector unit 510 is configured to engage with the embodiment of first connector unit 310 shown in FIGS. 7 and 8. Therefore, second connector unit 510 includes notch 900 located around interior space 550 where notch 900 is configured to engage with peg 700.

Figure 10:
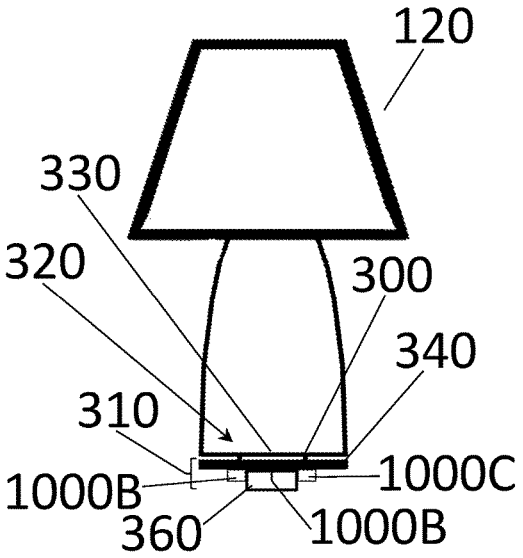
FIG. 10 shows a rear view of a decorative element with a connector unit with vertical panels.
Figure 11:
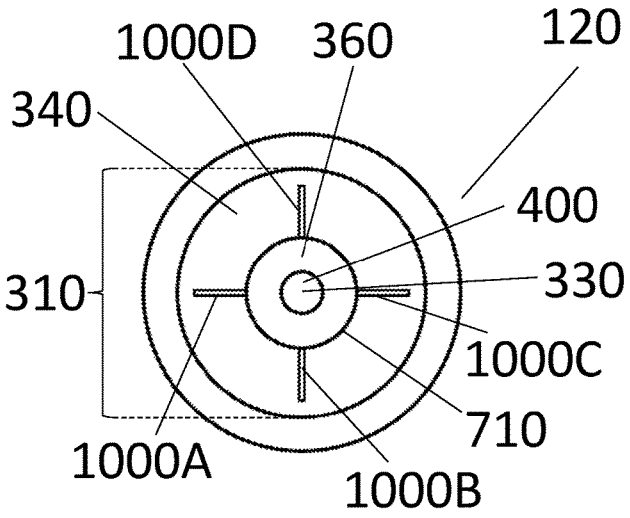
FIG. 11 shows a bottom view of a rotational element and a connector unit with vertical panels.

In another embodiment shown in FIGS. 10 and 11, first connector unit 310 does not include second disk 350, but instead includes a first panel 1000A located along an outer edge 710 of cylinder 360, a second panel 1000B located along an outer edge 710 of cylinder 360 approximately ninety degrees from first panel 1000A, a third panel 1000C located along an outer edge 710 of cylinder 360 approximately ninety degrees from second panel 1000B, and a fourth panel 1000D located along an outer edge 710 of cylinder 360 approximately ninety degrees from first panel 1000A and third panel 1000C (collectively, panels 1000). Panels 1000 are oriented approximately parallel to each other and approximately perpendicular to first disk 340.

Figure 12:
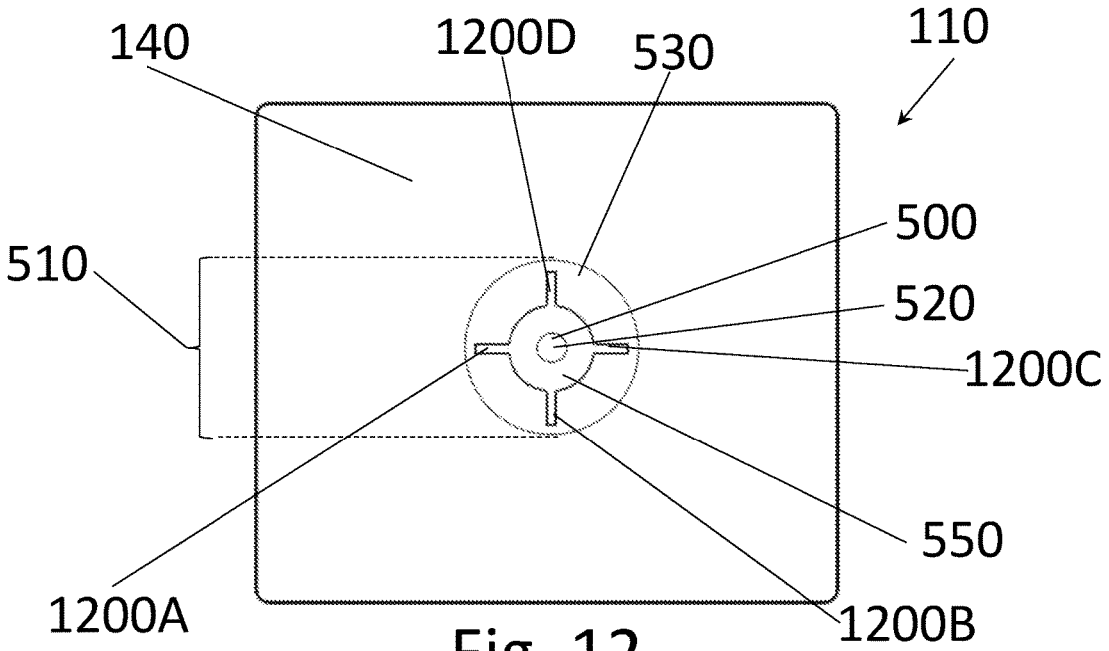
FIG. 12 shows a top view of a cabinet including a connector unit with notches for vertical panels.

In the embodiment shown in FIG. 12, second connector unit 510 is configured to engage with the embodiment of first connector unit 310 shown in FIGS. 10 and 11. Therefore, second connector unit 510 includes third disk 530 includes a first notch 1200 A located around empty interior space 550 of third disk 530, a second notch 1200 B located around interior space 550 of third disk 530 approximately ninety degrees from first notch 1200 A, a third notch 1200C located around interior space 550 of third disk 530 approximately ninety degrees from second notch 1200B, and a fourth notch 1200D located around interior space 550 of third disk 530 approximately ninety degrees from first notch 1200A and third notch 1200C (collectively, notches 1200). Notches 1200 are configured to engage with panels 1000.

Figure 13:
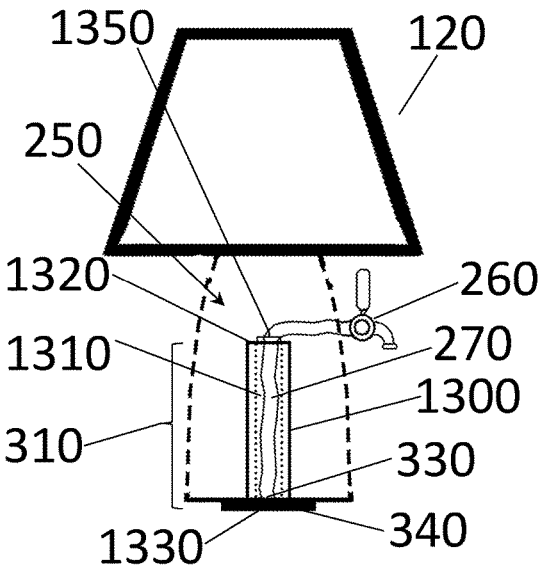
FIG. 13 shows an internal view of a decorative element with a connector unit that includes a vertical cylinder.
Figure 14:
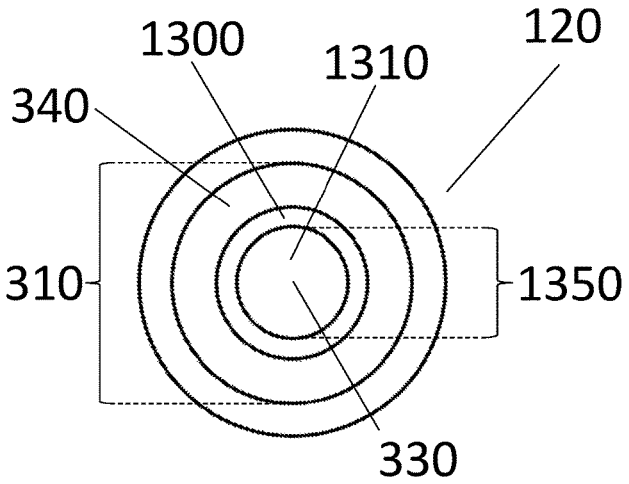
FIG. 14 shows a bottom view of a rotational element and a connector unit that includes a vertical cylinder.

In another embodiment shown in FIGS. 13 and 14, first connector unit 310 is shown as including first disk 340 and a first cylinder 1300 where first cylinder 1300 is attached to first disk 340 perpendicular to first disk 340 around central point 330 such that first cylinder extends 1300 into internal space 250. First cylinder 1300 further includes a first hollow space 1310 with a first opening 1320 located at a distal end of first cylinder 1300 and a second opening 1330 located at an opposing distal end of first cylinder 1300. First opening 1320, second opening 1330, and first hollow space 1310 each have approximately a circular shape with a first diameter 1350.

Figure 15:
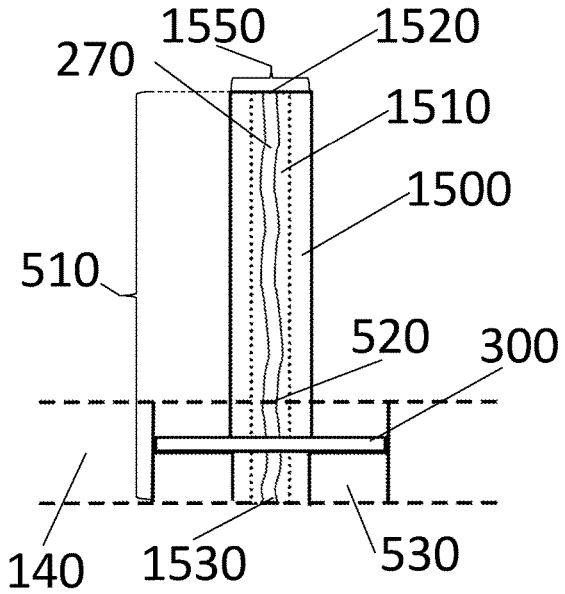
FIG. 15 shows a side view of a portion of a cabinet including a connector unit that includes a vertical cylinder.
Figure 16:
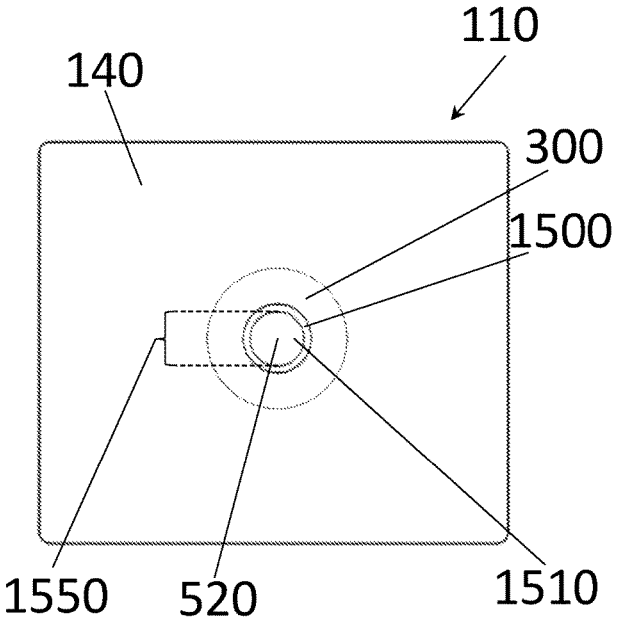
FIG. 16 shows a top view of a cabinet including a connector unit that includes a vertical cylinder.

In the embodiment shown in FIGS. 15 and 16, second connector unit 510 is configured to engage with the embodiment of first connector unit 310 shown in FIGS. 10 and 11. Therefore, second connector unit 510 includes disk 530 includes and a second cylinder 1500 where second cylinder 1500 is attached to disk 530 perpendicular to disk 530 around central point 520 of table 140. Second cylinder 1500 further includes a second hollow space 1510 with a third opening 1520 located at a distal end of second cylinder 1500 and a fourth opening 1530 located at an opposing distal end of second cylinder 1500. Third opening 1520, fourth opening 1530, and second hollow space 1510 each have approximately a circular shape and second cylinder 1500 has a second diameter 1550. In addition, second connector unit 510 further includes rotational element 300 attached above disk 530.

When second connector unit 510 interfaces with first connector unit 310, second cylinder 1500 is configured to interface with first cylinder 1300. Therefore, second diameter 1550 has a length less than that of the first diameter 1350 so that second cylinder 1500 can fit inside first hollow space 1310. This configuration allows second connector unit 510 interfaces with first connector unit 310 to interface for various thicknesses of table 140. In addition, this configuration provides stability for decorative element 120 while still allowing decorative element 120 to rotate on rotational element 300 and also providing a passage for beverage line 270 through second hollow space 1510.

Operation

Apparatus 100 dispenses beverages from a keg or other similar beverage container 220 stored in storage space 210. Beverages flow from beverage container 220 through beverage line 270 and out dispensing tap 260 when a user of apparatus 100 activates dispensing tap 260.

Figure 17:
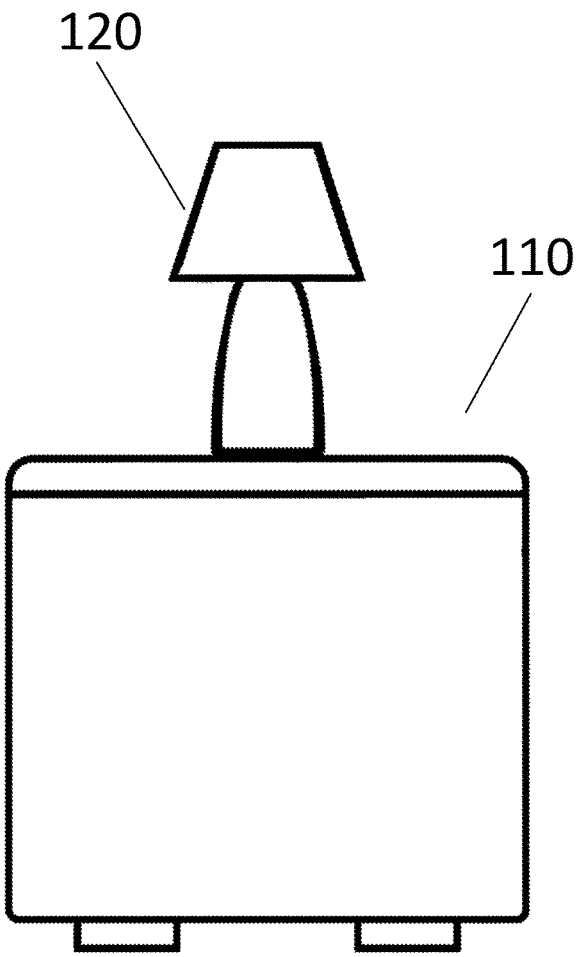
FIG. 17 shows a frontal view of an embodiment of a beverage dispensing apparatus including a cabinet and a rotated decorative element.
Figure 18:
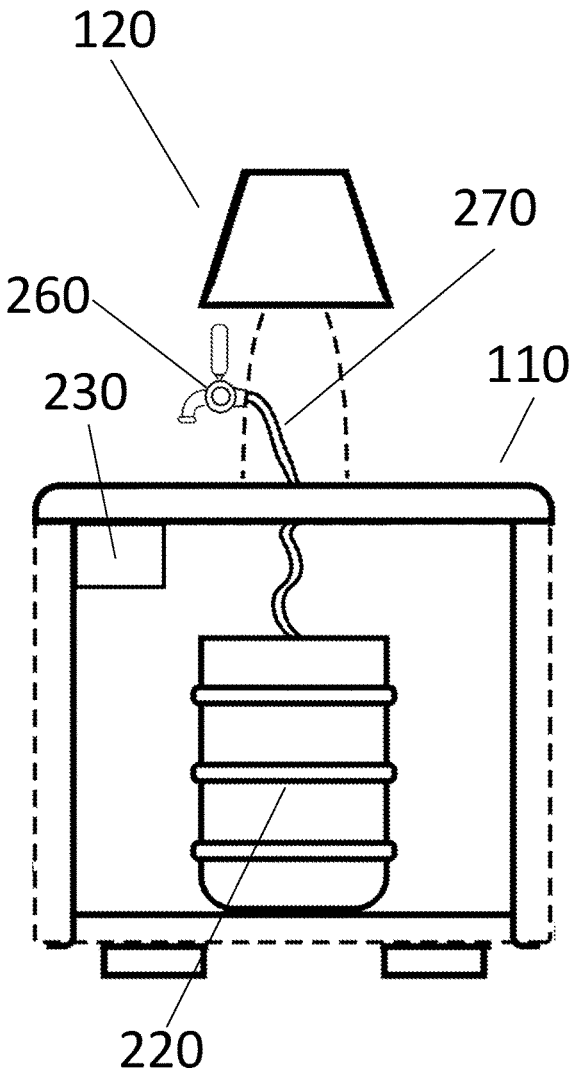
FIG. 18 shows a side view of an embodiment of a beverage dispensing apparatus with an internal view of a cabinet and a decorative element with a rotated decorative element.

As opposed to a kegerator, apparatus 100 is designed to be aesthetically suitable and resembling real furniture and decor. In an embodiment of apparatus 100, cabinet 110 has the appearance of a storage cabinet or set of drawers with panel 130 including a decorative façade (no shown). Dispensing tap 260 is also disguised in appearance from that of a dispensing tap generally included with a kegerator in that dispensing tap 260 is attached to decorative element 120. In addition, decorative element 120 rotates on rotational element 300, but is otherwise stationary relative to cabinet 110. As shown in FIGS. 17 and 18, when decorative element 120 rotates one hundred eighty degrees, dispensing tap 260 is no longer visible from a frontal view. This makes apparatus 100 just appear as a generic cabinet with a generic decorative element on top instead of an apparatus for dispensing beverages.

As appreciated by those skilled in the art, after having the benefit of this disclosure, decorative item 120 can take numerous forms including but not limited to a lamp, a vase, a statue, or other suitable items in which a beverage line and dispensing tap can be incorporated. In another embodiment, when decorative item 120 takes the form of a lamp or other electrical appliance, decorative item 120 includes the components to function as that electrical appliance (not shown).

Decorative item 120 and cabinet 110 each include connector unit 310 and connector unit 510 respectively in order to removably attach decorative item 120 to cabinet 110. When removably attached in this manner, beverage-line port 400 and beverage-line port 500 align, allowing beverage line 270 to pass from decorative item 120 to cabinet 110, thereby connecting dispensing tap 260 to beverage container 220.

In the embodiments disclosed herein, connector unit 310 and connector unit 510 are configured in a manner that allows for easy removal of decorative item 120. Therefore, a user of apparatus 100 can quickly swap out decorative item 120 in one form, such as a lamp, for a decorative item in another form, such as a vase, from which the user of apparatus 100 can then to dispense beverages. In addition, when not using apparatus 100 to dispense beverages, a user of apparatus 100 can swap out decorative item 120 for a decorative item that does not include dispensing tap 260, thereby completely disguising the nature of apparatus 100.

In another embodiment, cabinet 110 includes refrigeration unit 230 and insulation panels 240. Together, these elements maintain the beverage, such as beer, stored in beverage container 220 at a pleasing, chilled temperature. In yet another embodiment, cabinet 110 includes a drainage system and space for ice storage in order to maintain the temperature of the beverage stored in beverage container 220 (not shown). In one more embodiment, cabinet 110 includes a heating unit in place of refrigeration unit 230 in order to maintain a warm temperature for beverages such as mulled wine.

As described earlier, in one embodiment, feet 150 can take the form of wheeled feet. This allows a user of apparatus 100 to easily move apparatus 100 between rooms of a house or onto a deck or other similar outdoor space (not shown).

Assembly for Connecting Beverage Line and for Supporting a Tabletop Accessory

Figure 19:
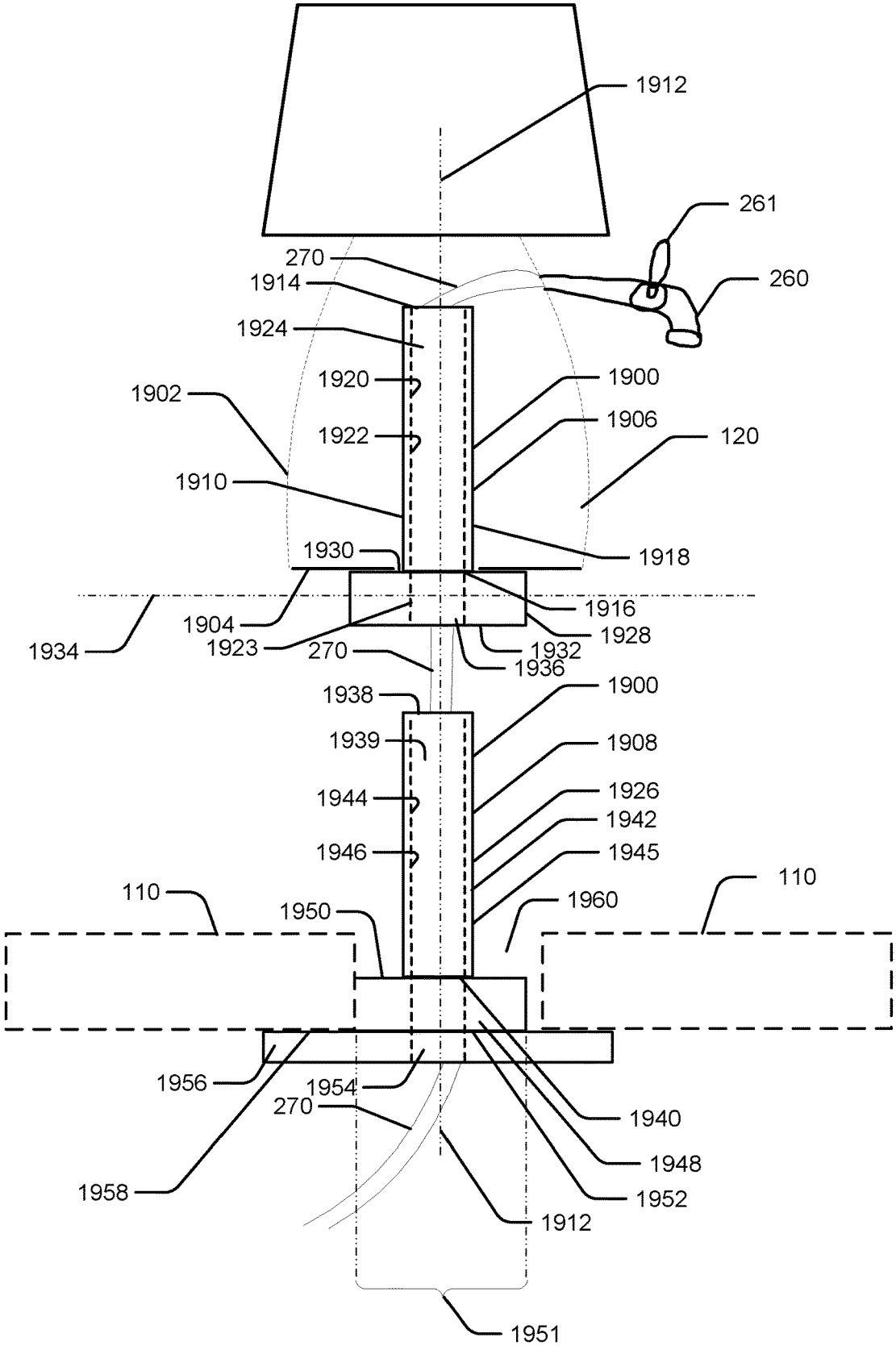
FIG. 19 shows a front exploded view of an example assembly 1900.

FIG. 19 shows a front exploded view of an example assembly 1900. As will be described, assembly 1900 provides a passageway for a beverage line 270 connected between a beverage vessel 220 (FIG. 18) and a dispensing tap 260 (FIG. 19). That is when accessory 1900 is secured to both cabinet 110 and a tabletop accessory 120, accessory 1900 provides: (i) a passageway for beverage line 270 while (ii) stabilizing and maintaining tabletop accessory 120 in a stationary and fixed position relative to the top of cabinet 110. In other words, assembly 1900 stabilizes a tabletop accessory 120 from toppling over, from the weight of a beverage line 270, plus the force of a person pushing or pulling on the handle 261 of dispensing tap 260.

As used herein, a tabletop accessory 120 is generally any suitable decorative element that may be placed on top of cabinet 110. (A tabletop accessory 120 is also referred to in this application as a "decorative element." The terms "tabletop accessory" and "decorative element" are sometimes referred to herein interchangeability.) Tabletop accessory 120 has sidewalls 1902 in which a dispensing tap 260 may be disposed at a level high enough vertically, measured from the base 1904 of the lamp to the dispensing tap 260, to enable a glass container, such as a wine glass, and beer mug, or the like, to be placed underneath dispensing tap 260 with sufficient clearance between the top of the glass, and the bottom of the dispensing tap 260.

Although tabletop accessory 120 is depicted as a lamp in the example illustration of FIG. 19, it should be appreciated by those skilled art after having the benefit of this disclosure, that tabletop accessory 120 may be any suitable decorative element having sidewalls 1902, such as a pot (not shown), a vase (not shown), a pot (not shown), a pitcher (not shown), a statue (not shown), an electrical appliance (not shown), a trophy (not shown), and other suitable tabletop accessories with sidewalls and a generally partially hollow interior.

In FIG. 19, assembly 1900 includes an upper connector 1906 and lower connector 1908 that slidably mate with each other.

Upper connector 1906 includes a female shaft 1910 extending along a longitudinal axis 1912. Female shaft 1910 has a distal end 1914 and a proximal end 1916. In one implementation, the length of female shaft is approximately four inches. Although as appreciated by those skilled in the art after having the benefit of this disclosure, female shaft 1910 may be shorter or longer depending upon the size of tabletop accessory 120.

Female shaft 1910 also includes an outer peripheral wall 1918 and an inner-peripheral wall 1920. As depicted, inner-peripheral wall 1920 defines an axial hole 1924 extending along an inner surface 1922 of the inner-peripheral wall 1920 from distal end 1914 to the proximal end 1916. That is, female shaft 1910 is generally hollow, and has a diameter large enough to slidably accommodate a male shaft 1926 associated with lower connector 1908 therein. In one implementation, the diameter of female shaft is approximately 1.25 inches. Although as appreciated by those skilled in the art after having the benefit of this disclosure, that the diameter of female shaft 1926 may be wider or narrower.

Upper connector 1906 also includes a base 1928 located along a portion of proximal end 1916 of female shaft 1910. Base 1928 may have a planar-upper surface 1930 and a planar-lower surface 1932 extending along a horizontal axis 1934 perpendicular to longitudinal axis 1912.

Base 1928 also includes an axial hole 1936 centrally located within base 1928 disposed between planar-upper surface 1930 and planar-lower surface 1932. Axial hole 1936 of base 1928 aligns with axial hole 1924 of female shaft 1910. Planar-upper surface 1930 of base 1928 is configured to be attached to a bottom-most portion (i.e., base 1904) of tabletop accessory 120 with female shaft 1910 residing at least partially inside a central-hollow portion of the tabletop accessory 120. As appreciated by those skilled in the art after having the benefit of this disclosure, base 1928 may be fastened directly or indirectly to base 1904 of tabletop accessory by any suitable fastening means including screw and bolt, adhesive, pins, clips, magnets, or any combination of the aforementioned.

Lower connector 1908 includes male shaft 1926 extending along longitudinal axis 1912. Male shaft 1926 has a distal end 1938 and a proximal end 1940. Male shaft 1926 also includes outer-peripheral wall 1942 and inner-peripheral wall 1944. Inner-peripheral wall 1944 defines an axial hole extending along an inner surface 1946 of inner-peripheral wall 1944 of male shaft 1926 from distal end 1938 to the proximal end 1940.

A substantial length (if not all) of male shaft 1926 fits within axial hole 1924 of female shaft 1910 as well axial hole 1936 of base 1928, such that inner-peripheral wall 1920 of female shaft 1910, and inner surface 1923 of axial hole 1936 of base 1928 fits coextensively around an outermost surface 1945 of outer-peripheral wall 1942 of male shaft 1926 when the female shaft 1910 slides over the male shaft 1926. For example, in one implementation, the total diameter of male shaft 1926 is 1.2 inches. As appreciated by those skilled in the art after having the benefit of this disclosure, the diameter of male shaft 1926 may be wider or narrower. The diameter of the axial hole 1939 of the male shaft 1926 is also large enough to accommodate a beverage line 270 when the beverage line is slid inside the male shaft 1926.

Lower connector 1908 also includes a base 1948 located along a portion of the proximal end 1940 of the male shaft 1926. Base 1948 has a planar-upper surface 1950 and a planar-lower surface 1952 extending along a horizontal axis 1934 perpendicular to the longitudinal axis 1912. The base 1948 includes an axial hole 1954 centrally located within the base 1948 disposed between the planar-upper surface 1950 and the planar-lower surface 1952. The axial hole 1954 aligns with the axial hole 1939 of the male shaft 1926. A portion 1951 of the planar-upper surface 1950 of the base 1948 is configured to abut and support at least a portion of the planar-lower surface 1932 of the base 1928 of the upper connector 1906 in parallel with the planar-upper surface 1950 of the base 1948. When the female shaft 1910 is slidably mated with the male shaft 1928 therein a portion of the planar-upper surface 1958 is configured to be fastened to a portion of the cabinet 110.

The height H" (FIG. 20) of a portion of 1951 of base 1948 with the height H' (FIG. 20) of base 1928 measured stacked one on top of the other in one implementation, is generally approximately the same or slightly smaller than the height of the hole 1960 cut through a surface of cabinet 110. In one implantation, the height H of both bases 1928 and 1948 are approximately 0.375 inches each, although in other implementations the height be greater or lesser than 0.375 inches.

Figure 20:
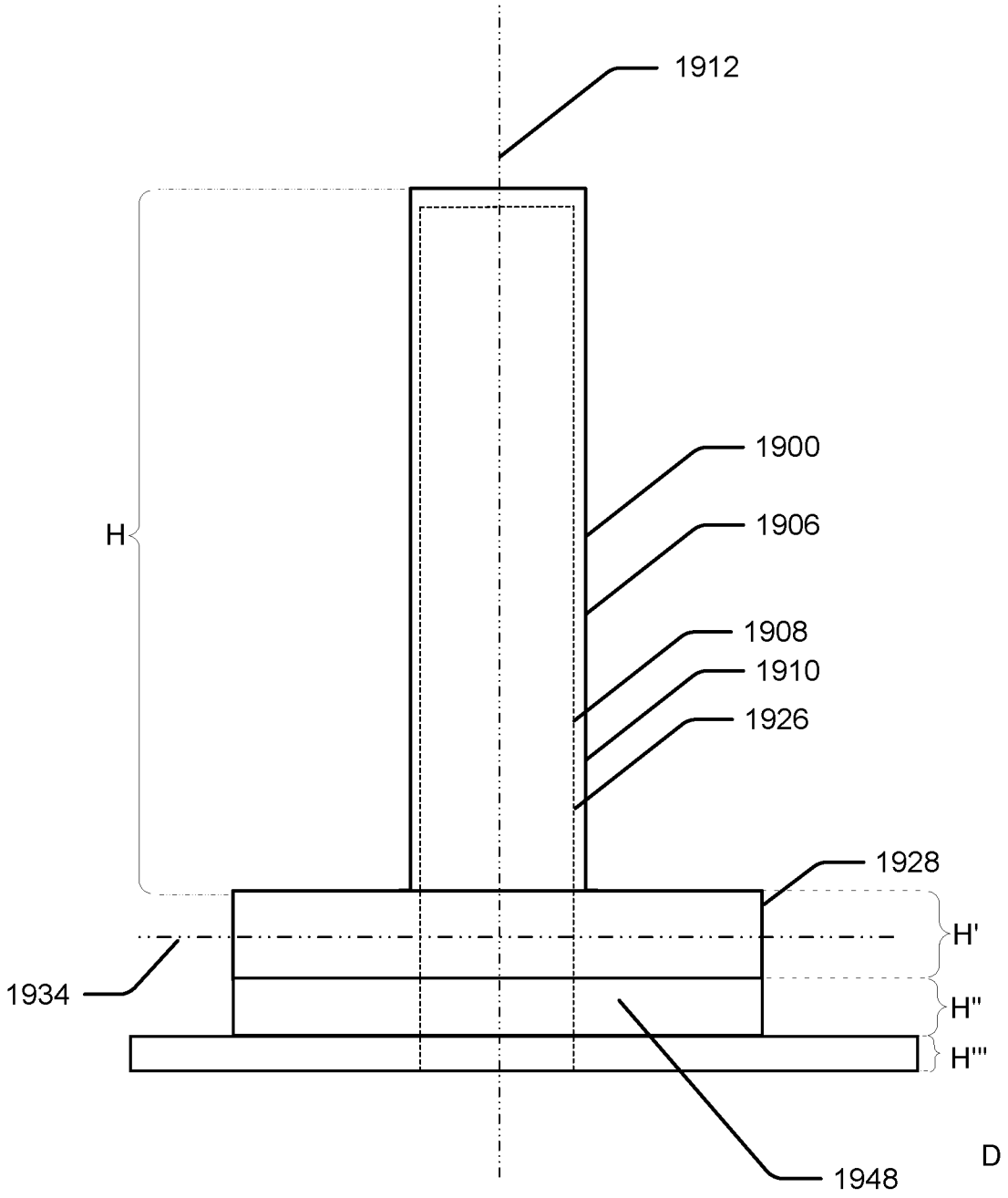
FIG. 20 is a sideview of assembly 1900.

Turning to FIG. 20, is a sideview of assembly 1900 with lower connector 1906 fitted (i.e., slidably mated) together. That is, female shaft 1910 is slid over male shaft 1926 (shown in cross section), which is contained within female shaft 1910. The height H of female shaft 1910 and male shaft 1926 are approximately equal, although either the female or male shaft may be slightly longer or shorter than the other.

As appreciated by those skilled in the art after having the benefit of this disclosure, base 1948 may be fastened directly or indirectly to cabinet 110 by any suitable fastening means including screws, screw and bolt, adhesive, pins, clips, magnets, or any combination of the aforementioned.

Figure 21:
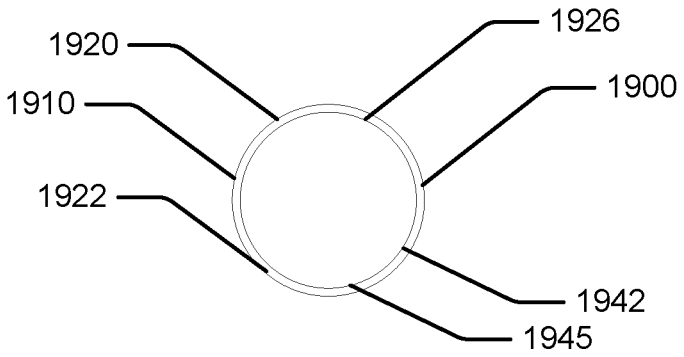
FIG. 21 shows a top view of female shaft 1910 mated with male shaft 1926 at the distal ends 1914 and 1938, respectively of each shaft.

FIG. 21 shows a top view of female shaft 1910 mated with male shaft 1926 at the distal ends 1914 and 1938, respectively of each shaft. Specifically, FIG. 21 also shows how inner surface 1922 of wall 1920 of female shaft 1910 fits coextensively around an outermost surface 1945 of outer-peripheral wall 1942 of male shaft 1926.

Figure 22:
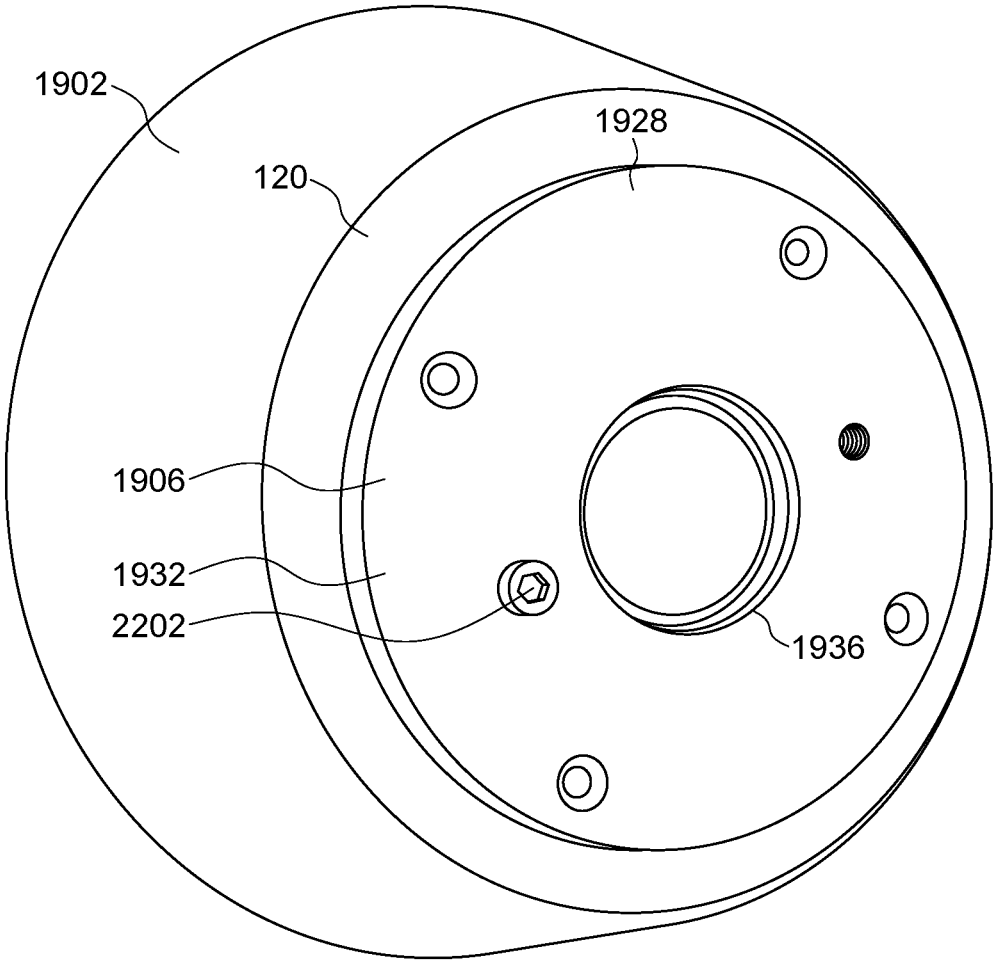
FIG. 22 shows a perspective view of base 1928 of upper connector 1906 attached to the base of tabletop accessory 120.

FIG. 22 shows a perspective view of base 1928 of upper connector 1906 attached to the base of tabletop accessory 120. As shown in FIG. 22, the planar-lower surface 1932 provides a surface to rest upon, through gravitational force in this example, the planar-upper surface 1950 (FIG. 19) of base 1948 (FIG. 19). A tab 2202 screwed into a hole (not visible) of the planar-lower surface 1932 of base 1928 protrudes from the lower-planar surface 1932. The tab 2202 is configured to fit within and engage a groove 2302 (FIG. 23) of base 1948 of the lower connector 1908 permitting clockwise and counterclockwise rotation of the tabletop accessory 120. The total length of the groove 2302 prevents the table accessory 120 from being twisted too far, which may cause the beverage line the beverage line to twist, and potentially break or crimp. In one implementation, the diameter of base 1928 is approximately 3.5 inches, although in other implementations the diameter may be greater than or lesser than 3.5 inches.

Figure 23:
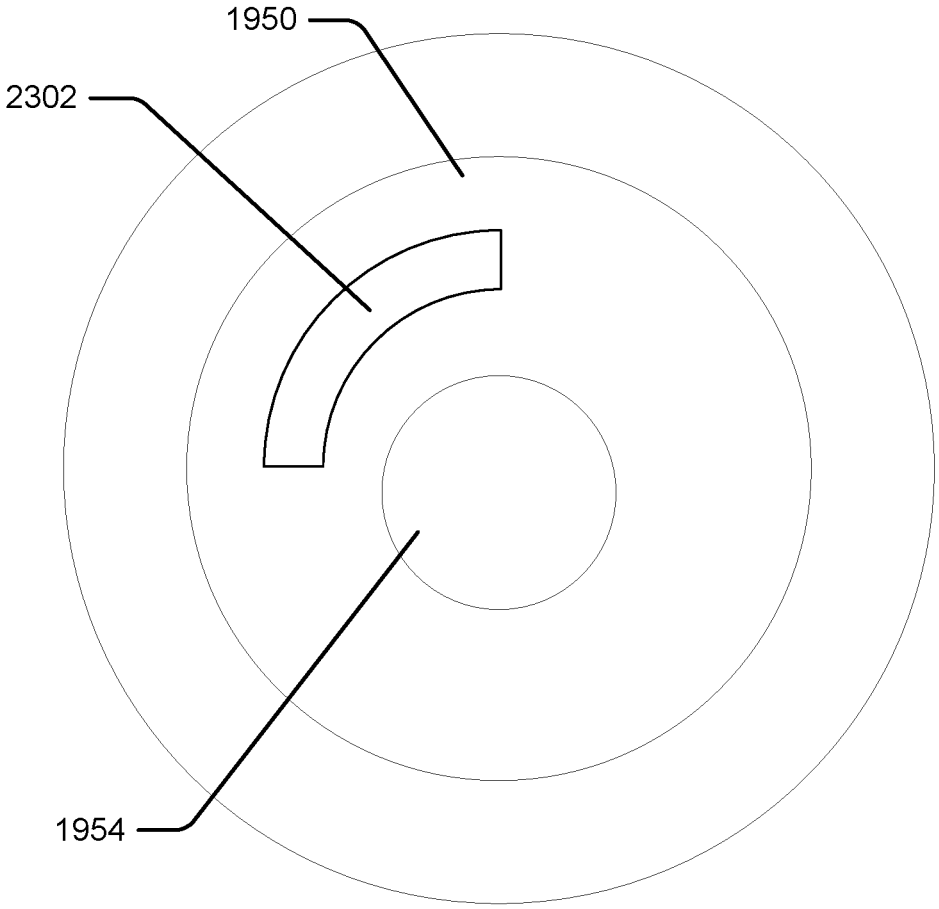
FIG. 23 shows a top view of base 1948.

FIG. 23 shows a top view of base 1948, and specifically a groove 2302 for engaging with tab 2202 (FIG. 22). As depicted in FIG. 23, groove 2303 is located within a portion of the planar-upper surface 1950 of base 1948.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

The invention claimed is:

1. An assembly for providing a passageway for a beverage line connected between a beverage vessel contained within a cabinet, and a beverage tap secured to a tabletop accessory located on a top surface of the cabinet, wherein the tabletop accessory includes at least one of: a base for a lamp, a vase, a pot, and a pitcher, wherein the assembly comprises:

an upper connector comprising:

(a) a female shaft extending along a longitudinal axis having a distal end and a proximal end, and an outer and inner-peripheral wall, wherein the inner-peripheral wall defines an axial hole extending along an inner surface of the inner-peripheral wall from the distal end to the proximal end; and (b) a first base located along a portion of the proximal end of the female shaft, the first base having a planar-upper surface and a planar-lower surface extending along a horizontal axis perpendicular to the longitudinal axis, wherein the first base includes an axial hole centrally located within the base disposed between the planar-upper surface and the planar-lower surface, the axial hole of the first base aligns with the axial hole of the female shaft; wherein the planar-upper surface of the first base is configured to be attached to a bottom-most portion of the tabletop accessory, with the female shaft residing at least partially inside a central hollow central portion of the tabletop accessory;

a lower connector comprising:

(c) a male shaft extending along the longitudinal axis having a distal end and a proximal end, and an outer and inner-peripheral wall, wherein the inner-peripheral wall of the male shaft defines an axial hole extending along an inner surface of the inner-peripheral wall of the male shaft from the distal end to the proximal end of the male shaft; wherein a substantial portion of the male shaft fits within the axial hole of the female shaft and the axial hole of the base of the upper connector, such that the inner-peripheral wall of the female shaft and inner surface of the axial hole of the base of the upper connector fits coextensively around the outer-peripheral wall of the male shaft when the female shaft slides over the male shaft; wherein the diameter of the axial hole of the male shaft is large enough to accommodate a beverage line when the beverage line is slid inside the male shaft; and (d) a second base located along a portion of the proximal end of the male shaft, the second base having a planar-upper surface and a planar-lower surface extending along a horizontal axis perpendicular to the longitudinal axis, wherein the second base includes an axial hole centrally located within the second base disposed between the planar-upper surface and the planar-lower surface of the second base, wherein the axial hole of the second base aligns with the axial hole of the male shaft; wherein a portion of the planar-upper surface of the second base is configured to abut and support at least a portion of the lower surface of the first base of the upper connector in parallel with the planar-upper surface of the second base, when the female shaft is slidably mated with the male shaft therein; wherein a portion of the planar-upper surface is configured to be fastened to a portion of the cabinet.

2. The assembly of claim 1, wherein when (i) the tabletop accessory is fastened to the first base, (ii) the second base is fastened to the cabinet, and (iii) the female shaft is slide over the male shaft, the assembly provides support for maintaining the tabletop accessory in a stable, upright position.

3. The assembly of claim 1, wherein the second base further includes a groove located in a portion of the upper-planar surface of the second base.

4. The assembly of claim 1, wherein the first base further includes a tab protruding from a portion of the lower-planar surface of the first base.

5. The assembly of claim 1, wherein the second base further includes a groove located in a portion of the upper-planar surface of the second base, wherein the first base further includes a tab protruding from a portion of the lower-planar surface of the first base configured to fit within and engage the groove.

6. The assembly of claim 1, wherein the upper connector is rotatable in clockwise or counterclockwise direction relative to the lower connector, when the female shaft is mated with the male shaft therein.

7. The assembly of claim 1, wherein a portion of the upper-planar surface of the second base is configured to reside within a hole located through the cabinet.

8. The assembly of claim 1, wherein a lower-planar surface of the first base is configured to seat and reside fully within a hole located in the cabinet, when the female shaft slidably mated with male shaft.

9. The assembly of claim 1, wherein a portion of the upper-planar surface of the second base is configured to be fastened to a horizontal upper-inner surface of the cabinet.

10. A method of making assembly configured to provide a passageway for a beverage line connected between a beverage vessel contained within a cabinet, and a beverage tap secured to a tabletop accessory located on a top surface of the cabinet, wherein the tabletop accessory includes at least one of: a base for a lamp, a vase, a pot, and a pitcher, wherein the method of making the assembly comprises the steps of:

configuring an upper connector to have (a) a female shaft extending along a longitudinal axis having a distal end and a proximal end, and an outer and inner-peripheral wall, wherein the inner-peripheral wall defines an axial hole extending along an inner surface of the inner-peripheral wall from the distal end to the proximal end; and (b) a first base located along a portion of the proximal end of the female shaft, the first base having a planar-upper surface and a planar-lower surface extending along a horizontal axis perpendicular to the longitudinal axis, wherein the first base includes an axial hole centrally located within the base disposed between the planar-upper surface and the planar-lower surface, the axial hole of the first base aligns with the axial hole of the female shaft; wherein the planar-upper surface of the first base is configured to be attached to a bottom-most portion of the tabletop accessory, with the female shaft residing at least partially inside a central hollow portion of the tabletop accessory;

configuring a lower connector to have: (c) a male shaft extending along the longitudinal axis having a distal end and a proximal end, and an outer and inner-peripheral wall, wherein the inner-peripheral wall of the male shaft defines an axial hole extending along an inner surface of the inner-peripheral wall of the male shaft from the distal end to the proximal end of the male shaft; wherein a substantial portion of the male shaft fits within the axial hole of the female shaft and the axial hole of the base of the upper connector, such that the inner-peripheral wall of the female shaft and inner surface of the axial hole of the base of the upper connector fits coextensively around the outer-peripheral wall of the male shaft when the female shaft slides over the male shaft; wherein the diameter of the axial hole of the male shaft is large enough to accommodate a beverage line when the beverage line is slid inside the male shaft; and (d) a second base located along a portion of the proximal end of the male shaft, the second base having a planar-upper surface and a planar-lower surface extending along a horizontal axis perpendicular to the longitudinal axis, wherein the second base includes an axial hole centrally located within the second base disposed between the planar-upper surface and the planar-lower surface of the second base, wherein the axial hole of the second base aligns with the axial hole of the male shaft; wherein a portion of the planar-upper surface of the second base is configured to abut and support at least a portion of the lower surface of the first base of the upper connector in parallel with the planar-upper surface of the second base, when the female shaft is slidably mated with the male shaft therein; wherein a portion of the planar-upper surface is configured to be fastened to a portion of the cabinet.

11. The method of claim 10, further comprising the steps of fastening the tabletop accessory to the first base, (ii) fastening the second base to the cabinet, and (iii) sliding the female shaft over the male shaft.

12. The method of claim 10, further comprising configuring a groove in a portion of the upper-planar surface of the second base.

13. The method of claim 10, further comprising configuring a tab to protrude from a portion of the lower-planar surface of the first base.

14. The method of claim 10, further comprising fastening the lower connector to the cabinet.

15. An assembly for providing a passageway for a beverage line connected between a beverage vessel contained within a cabinet, and a beverage tap secured to a tabletop accessory located on a top surface of the cabinet, wherein the tabletop accessory includes at least one of: a base for a lamp, a vase, a pot, and a pitcher, wherein the assembly comprises:

an upper connector comprising:

(a) a female shaft extending along a longitudinal axis having a distal end and a proximal end, and an outer and inner-peripheral wall, wherein the inner-peripheral wall defines an axial hole extending along an inner surface of the inner-peripheral wall from the distal end to the proximal end; and (b) a first base located along a portion of the proximal end of the female shaft, the first base having a planar-upper surface and a planar-lower surface extending along a horizontal axis perpendicular to the longitudinal axis, wherein the first base includes an axial hole centrally located within the base disposed between the planar-upper surface and the planar-lower surface, the axial hole of the first base aligns with the axial hole of the female shaft;

a lower connector comprising:

(c) a male shaft extending along the longitudinal axis having a distal end and a proximal end, and an outer and inner-peripheral wall, wherein the inner-peripheral wall of the male shaft defines an axial hole extending along an inner surface of the inner-peripheral wall of the male shaft from the distal end to the proximal end of the male shaft; wherein a substantial portion of the male shaft fits within the axial hole of the female shaft, such that the inner-peripheral wall of the female shaft fits coextensively around the outer-peripheral wall of the male shaft when the female shaft slides over the male shaft; wherein the diameter of the axial hole of the male shaft is large enough to accommodate a beverage line when the beverage line is slid inside the male shaft, and small enough to fit within the female shaft; and (d) a second base located along a portion of the proximal end of the male shaft, the second base having a planar-upper surface and a planar-lower surface extending along a horizontal axis perpendicular to the longitudinal axis, wherein the second base includes an axial hole centrally located within the second base disposed between the planar-upper surface and the planar-lower surface of the second base, wherein the axial hole of the second base aligns with the axial hole of the male shaft; wherein a portion of the planar-upper surface of the second base is configured to abut and support at least a portion of the lower surface of the first base of the upper connector in parallel with the planar-upper surface of the second base, when the female shaft is slidably mated with the male shaft therein; wherein a portion of the planar-upper surface is configured to be fastened to a portion of the cabinet.

* * * * *